US005094353A

United States Patent [19]

Paques

[11] Patent Number: 5,094,353

[45] Date of Patent: Mar. 10, 1992

[54] CLAMPING DEVICE FOR CRANE OR THE LIKE

[75] Inventor: Joseph-Jean Paques, Montréal, Canada

[73] Assignee: Institut de Recherche en Sante et en Securite du Travail du Quebec, Montréal, Canada

[21] Appl. No.: 686,931

[22] Filed: Apr. 18, 1991

[51] Int. Cl.[5] ..... B66C 13/18

[52] U.S. Cl. ..... 212/149; 212/151; 403/328

[58] Field of Search ..... 403/328; 212/149–153, 212/159

[56] References Cited

U.S. PATENT DOCUMENTS

| | | | |
|---|---|---|---|
| 895,646 | 8/1908 | Ladd . | |
| 1,841,008 | 1/1932 | Burn | 403/328 |
| 3,285,430 | 11/1966 | Whitmire | 212/151 |
| 3,456,810 | 7/1969 | Ely | 212/151 |
| 3,572,784 | 3/1971 | Pansini . | |
| 3,664,515 | 5/1972 | Orendorff et al. | 212/151 |
| 3,926,418 | 12/1975 | Blatt . | |
| 4,085,856 | 4/1978 | Westendorf | 403/328 |
| 4,243,342 | 1/1981 | Marto | 403/328 |
| 4,635,327 | 1/1987 | Netznik | 403/328 |

*Primary Examiner*—Joseph F. Peters, Jr.
*Assistant Examiner*—R. B. Johnson
*Attorney, Agent, or Firm*—Oblon, Spivak, McClelland, Maier & Neustadt

[57] ABSTRACT

The disclosure herein describes a clamping device to be mounted to an element of a crane and which provides contact surfaces for limit switches that maintain the movement of a movable crane structure within predetermined limits. The clamping device defines a body having a top wall which is contacted by the limit switches and a side wall which cooperates with a plunger to clamp the device to the crane element. The plunger is spring-biased so that its head applies constant pressure against the crane element. The housing, in which the plunger is contained, includes a handle which acts as a lever to compress the spring to allow retraction of the head from the crane element and quick removel of the clamping device from the crane element.

5 Claims, 3 Drawing Sheets

CLAMPING DEVICE FOR CRANE OR THE LIKE

FIELD OF THE INVENTION

The present invention pertains to a clamping device which is adapted to be mounted to an element of a crane, or similar machines, and which serves as an actuator for limit switches mounted on a movable structure of the crane to maintain the movement of this structure within predetermined limits.

BACKGROUND OF THE INVENTION

It is essential to confine the operation of the projecting boom or other rotatable and/or pivotable structures of a crane within a predefined range in order to avoid contact with adjacent elements such as electrical wires, buildings or other structures located at the working site.

At present, cam surfaces are fixedly secured to a curb-ring provided on a crane platform disposed adjacent a rotating derrick or the pivoting boom of the crane. The mounting of these cam surfaces is usually accomplished by fixing them by means of bolts which extend through the cam members and which pressed them on the curb-ring. This is time-consuming, especially in cases where it is wished to frequently vary the working range of the movable crane structure.

OBJECTS AND STATEMENT OF THE INVENTION

It is an object of the present invention to provide a quick coupling device for mounting to the above-mentioned crane element, thus avoiding the use of fastening elements, such as bolts and nuts.

This is achieved by providing a clamping device which may be manually mounted to and dismounted from the crane element.

The present invention therefore relates to a clamping device for use on cranes or the like, which comprises:

a body having a top wall adapted to extend over the crane element and a side wall adapted to lie adjacent to and contact one side face of the crane element;

a housing mounted to the top wall of the body and extending on an opposite side face of the crane element;

plunger means, mounted in the housing, having a head protruding the housing and a spring causing the head to maintain contact pressure against the opposite side face of the crane element; and handle means mounted to the housing and being actuatable for compressing the spring to enable retraction of the head from the opposite side face of the crane element and the removal of the clamping device therefrom.

In one form of the invention, the handle means consist of a first handle fixed to the housing and of a manually actuatable lever having a first portion adapted to compress the spring and a second portion defining a second handle which extends substantially parallel to the first handle.

In another embodiment of the invention, a third handle is fixedly mounted to the clamping device to allow the user to use both hands for its removal from the crane.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENT

Figure 1:
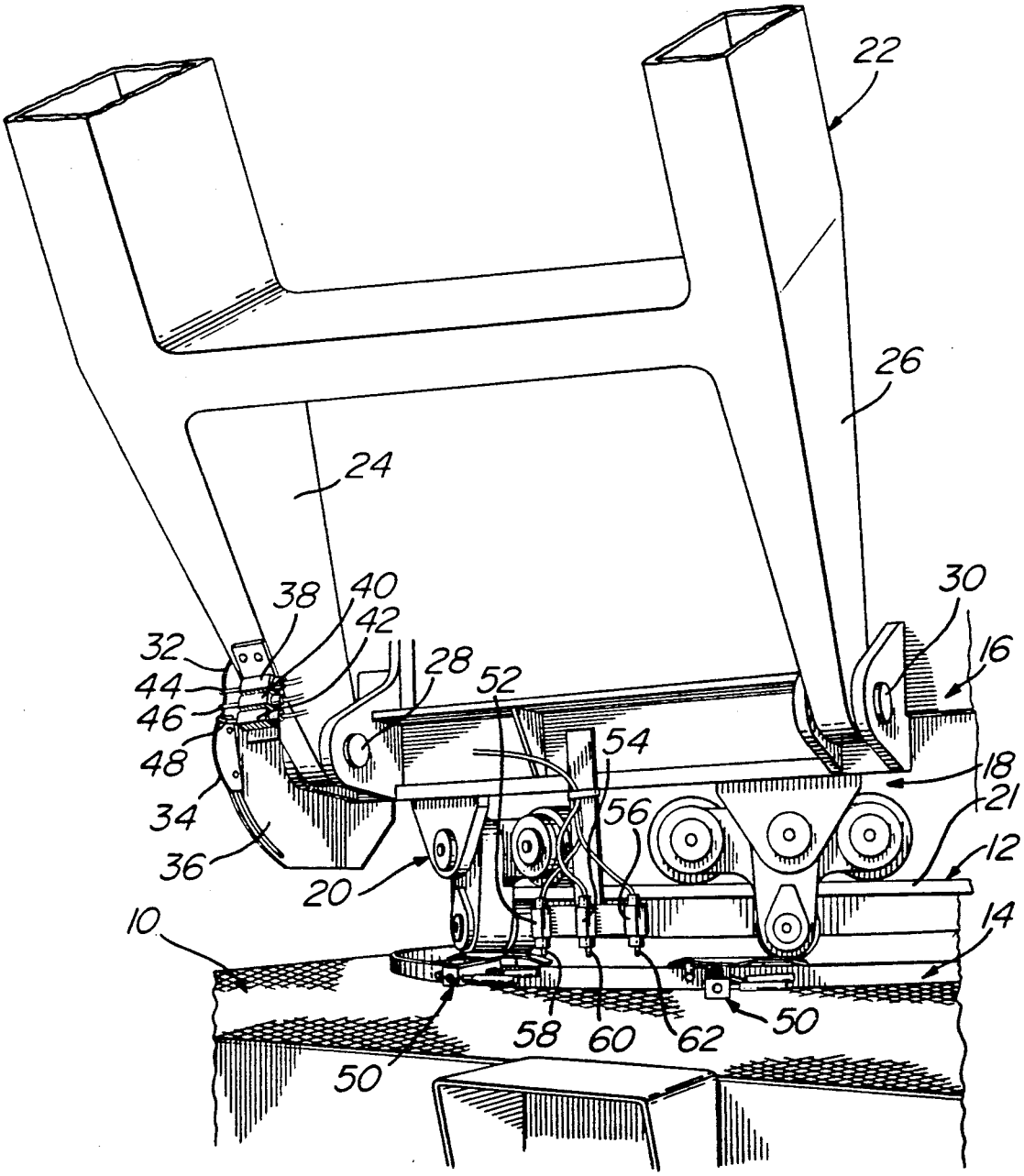
FIG. 1 is a perspective view showing parts of a crane on which is mounted a pair of clamping devices made in accordance with the present invention; this figure also shows devices of the prior art.

Referring to FIG. 1, there is shown only those parts of a crane that are required to understand the use of the present invention. They include a platform 10 on which is secured a fixed element or structure 12 having an outer curb-ring 14. Disposed within the curb-ring, a rotatable structure 16 includes a pair of roller assemblies 18 and 20 adapted to ride on the peripheral edge 21 of the fixed element 12. The rotatable structure 16 carries a boom 22 including a pair of arms 24 and 26 which are pivotally connected at 28 and 30, respectively, above the roller assemblies 18 and 20. Thus, arms 24 and 26 may be displaced circumferentially with respect to a vertical axis extending through the structure 12 and vertically with respect to the axes 28 and 30.

During the operation of the crane, it is essential that these two rotational movements of the arms be maintained within pre-determined limits in order to avoid contact with adjacent elements, such as electrical wires, building or their like structures.

To illustrate the prior art, cam devices 32 and 34 have been shown in FIG. 1, mounted on a vertically extending plate 36 which is fixed to the rotatable structure 16 and disposed adjacent one arm 24 of the boom. Three limits switches 38, 40 and 42 are shown fixedly secured to the arm 24, each having an actuatable finger 44, 46 and 48 which, when contacting the cam surfaces, give an electrical signal in the cabin to the operator of the crane. Whenever fingers 44 and 48 are actuated, this will indicate that the boom has reached the limits of displacement for this particular work of the crane. The middle limit switch is provided to cause an immediate stoppage of the displacement of the crane boom. With these prior cam devices, one can conclude that for each distinct operation of the boom, the cam devices must be unbolted and rebolted for the next operation.

The present invention overcomes these problems by providing a clamping device, two of which are shown as 50 on curb-ring 14. It should be understood that cam devices 32 and 34 have been illustrated to show the prior art and should also be replaced with cam devices similar to devices 50 of the present invention.

Figure 2:
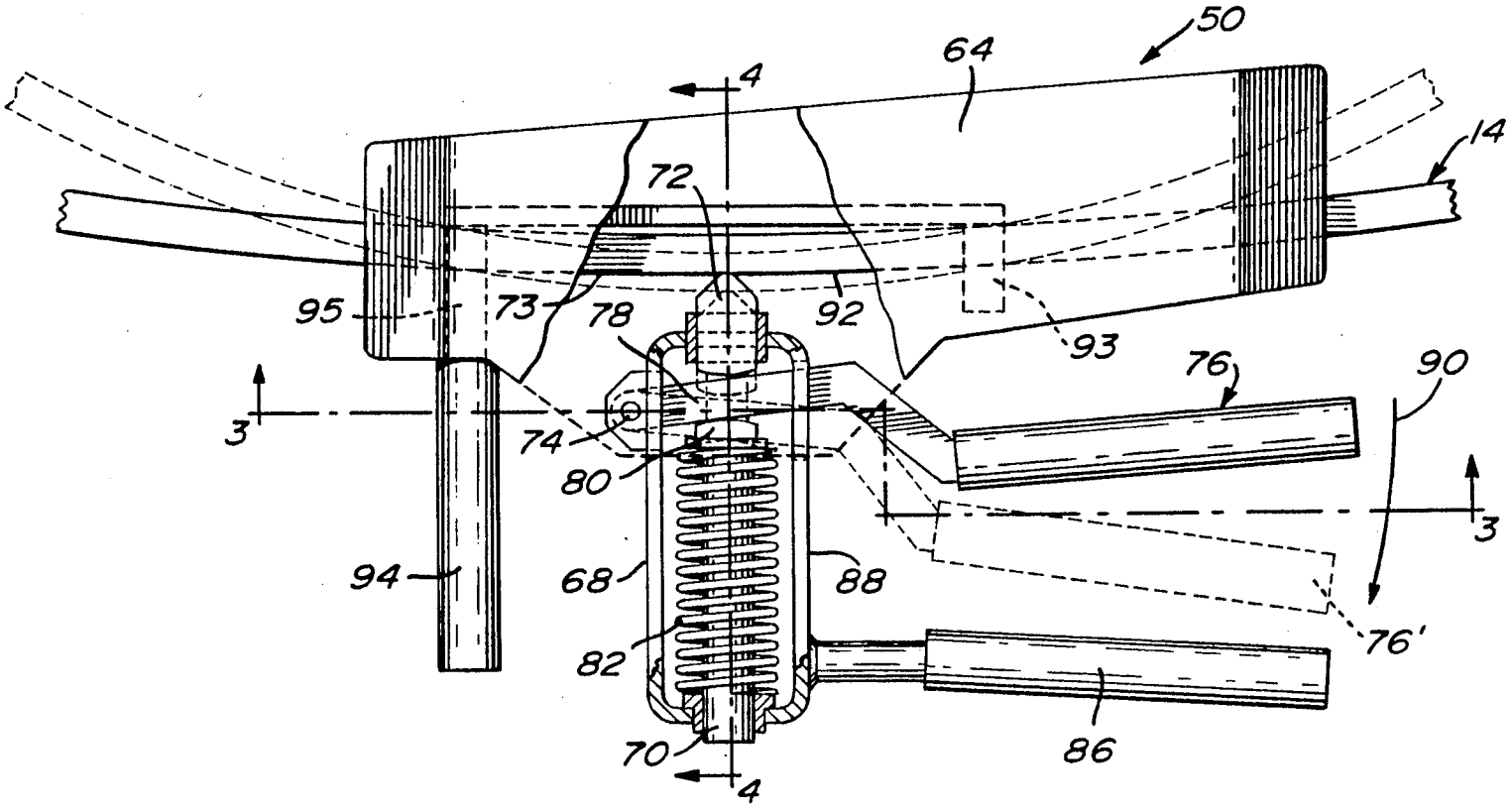
FIG. 2 is a top plan view of the clamping device with parts broken away.
Figure 3:
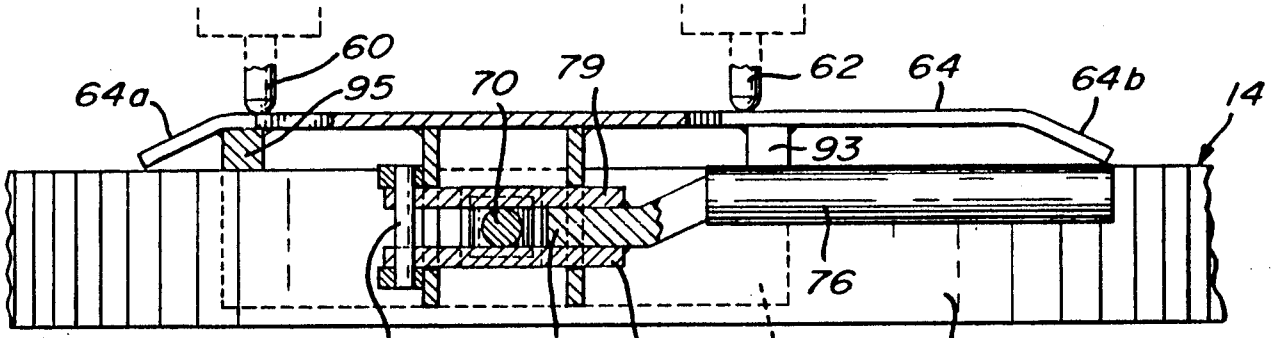
FIG. 3 is a front elevational cross-section as taken from the lines of 3—3 of FIG. 2.
Figure 4:
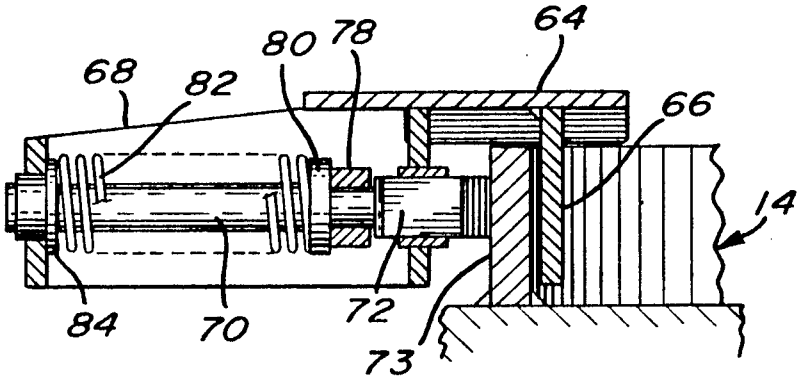
FIG. 4 is a side elevational cross-section as taken from lines 4—4 of FIG. 2.

Referring to FIGS. 2, 3 and 4, each clamping device 50 defines an L-shaped body having a top wall 64 and a side wall 66. The top wall has a generally flat intermediate surface and two opposite slightly inclined end surfaces **64*a* and 64*b***, the latter providing a sliding ramp for the fingers of the limit switches (rollers may be used for the fingers).

As illustrated in FIG. 4, the side wall 66 lies adjacent to the inner wall of the curb-ring 14, but due to the curvature of the ring 14 has two contact lines with the inner wall of the curb-ring.

A rectangular housing 68 extends frontwardly of the L-shaped body and is fixedly secured to the underside of the top wall 64. Extending longitudinally through the housing is a plunger 70 with a head 72 protruding from the housing and contacting the outer face 73 of the curb-ring. Extending transversely of the housing is a lever 76 that includes a portion 78 which is pivotally mounted at 74 to the housing and contacts an abutment 80 of the plunger. As illustrated in FIG. 3, portion 78 of the handle defines a yoke-like member having a pair of legs extending on both sides of the plunger 70. A spring 82 is confined between the abutment 80 and the rear wall 84 of the housing. In the position shown in FIG. 2, the spring 82 is in a compressed state thus forcing the plunger head 72 against the inner wall 73 of the curb-ring.

A second handle 86 is fixedly mounted at 88 to the outside wall 88 of the housing 68. Hence, by manually grasping handles 76 and 86 in the direction of arrow 90, the spring 82 will be further compressed and the plunger 72 removed from its contact on the curb-ring outer wall 73.

The underside of the top wall 64 has a pair of blocks 93 and 95 which rest on the upper edge of the curb-ring 14; one block 95 extends somewhat further outwardly than the block 93. To assist in the removal of the entire clamp device from the curb-ring 14, a third handle 94 is fixedly mounted to the block 95 so that the operator can use both hands to remove the relatively heavy device of the present invention.

Although the invention has been described above in relation to a specific form, it will be evident to the person skilled in the art that it may be modified and refined in various ways. It is therefore wished to have it understood that the present invention should not be limited in interpretation except by the terms of the following claims.

The embodiments of the invention in which an exclusive property or privilege is claimed are defined as follows:

1. For use in association with a crane element disposed adjacent to a movable structure of the crane, the crane element having a first side face and an opposite side face, a clamping device adapted to be contacted by switch means mounted onto said movable structure for maintaining movement of said structure within predetermined limits, said clamping device comprising:

a body having a top wall adapted to extend over said crane element and a side wall adapted to lie adjacent and to contact said first side face of said crane element;

a housing mounted to said top wall and extending on said opposite side face of said crane element;

plunger means mounted in said housing; said plunger means having a head protruding from said housing to contact said opposite side face and including a spring causing said head to maintain contact pressure against said opposite side face; and handle means mounted to said housing and being actuatable for compressing said spring to retract said head from said opposite side face of said crane element to enable removal of the clamping device from said crane element;

wherein said handle means include a first handle fixedly secured to said housing and a lever pivotally mounted to said housing; said lever having a first portion engaging said spring and a second portion defining a handle extending substantially parallel to said first handle.

2. A clamping device as defined in claim 1, wherein said housing is fixedly mounted to said top wall and extends therebeneath perpendicularly to said opposite side face of said crane element.

3. A clamping device as defined in claim 1, further comprising a third handle fixedly secured to said top wall for assisting in positioning and retracting said clamping device on and from said crane element

4. A clamping device as defined in claim 1, wherein said top wall defines an intermediate flat planar outer face and two opposite sloping end faces to provide riding contact of said switch means thereon.

5. A clamping device as defined in claim 1, wherein said crane element is a curb-ring mounted on a platform of the crane; said side wall of said body defining two contact points on the first side face of said curb-ring; said head contacting said opposite side face of said curb-ring at a third contact point located substantially at mid-point between said first and second contact points on said first side face of said curb-ring.

* * * * *